US006786239B1

(12) United States Patent
Welsh

(10) Patent No.: US 6,786,239 B1
(45) Date of Patent: Sep. 7, 2004

(54) HUB AND METHOD FOR STORAGE OF A SPIGOT CAP

(76) Inventor: Charles A. Welsh, 2300 Beechersbrook La., Madison, OH (US) 44057

( * ) Notice: Subject to any disclaimer, the term of this patent is extended or adjusted under 35 U.S.C. 154(b) by 0 days.

(21) Appl. No.: 10/608,245

(22) Filed: Jun. 27, 2003

(51) Int. Cl.[7] ..... F16K 43/00
(52) U.S. Cl. ..... 137/800; 137/360
(58) Field of Search ..... 137/296, 360, 137/800; 220/379

(56) References Cited

U.S. PATENT DOCUMENTS

| | | | | |
|---|---|---|---|---|
| 156,777 A | * | 11/1874 | Dickey | 137/360 |
| 306,527 A | | 10/1884 | Rueter | |
| 519,879 A | | 5/1894 | Sevens, Jr. | |
| 1,595,676 A | | 8/1926 | Merkert | |
| 2,069,849 A | | 2/1937 | Rich | |
| 3,304,039 A | | 2/1967 | Edelman et al. | 248/108 |
| 3,602,244 A | | 8/1971 | Ward | 137/119 |
| 4,167,259 A | | 9/1979 | Bury | 248/205 A |
| 4,653,711 A | | 3/1987 | Marshell | 248/205.3 |
| 4,955,572 A | | 9/1990 | Simmons | 248/312 |
| 5,096,154 A | | 3/1992 | Ellis | 248/683 |
| 5,197,605 A | | 3/1993 | Hampton | 206/582 |
| 5,819,984 A | | 10/1998 | Krueger | 222/181.2 |

* cited by examiner

*Primary Examiner*—Gerald A. Michalsky
(74) *Attorney, Agent, or Firm*—James A. Lucas; Driggs, Lucas, Brubaker & Hogg Co., LPA

(57) ABSTRACT

A storage hub is described for the temporary storage of a cap of the type typically threaded onto the outlet of a spigot to prevent leakage. The hub comprises a generally U-shaped body that can be mounted on the valve stem of a spigot, on top of the handle. Alternatively, it can be mounted on the wall of the structure on which the spigot is mounted. The hub has a generally cylindrical body provided with external threads onto which the cap is threaded. Several means are described for securing the hub to the spigot or to the adjoining wall structure. Among them is the use of magnetic attraction, a suitable adhesive, a nail, or a threaded fastener. An alternative is for the hub and the valve handle to be a unitary structure. The hub can be made from a polymer, an elastomer or metal.

18 Claims, 2 Drawing Sheets

HUB AND METHOD FOR STORAGE OF A SPIGOT CAP

BACKGROUND OF THE INVENTION

1. Field of the Invention

The invention relates to the storage of caps used to close off the outlet of water spigots and the like. More specifically, it relates to a storage hub for use in proximity to a spigot for storing such a cap when not in use.

2. Discussion of the Prior Art

Spigots or faucets (the two terms are used interchangeably herein) are common fixtures in most residences as well as commercial and industrial establishments. These faucets typically include a body connected to a source of liquid such as water, a valve within the body, a valve handle to turn the spigot on or off and to control the rate of flow, and an outlet. Most outlets, particularly those used on the exterior of residences are provided with male threads so that they can be attached to garden hoses and the like.

Leaky faucets are a perpetual problem for homeowners and others. Slow drips and leaks, due to a failure to completely shut off the flow of liquid, and the normal wearing out of washers commonly used in the valve of the spigots, result in the dissipation and waste of the liquid and the attendant costs associated therewith. One temporary solution is to thread a cap onto the threaded end of the spigot to contain further leakage. Also, the valve handle can be inadvertently turned on, possibly with disastrous results. During the use of the spigot, the cap must of necessity be removed from the outlet. However, once it is removed, there is an increased likelihood that the cap will become lost, damaged or misplaced.

BRIEF DESCRIPTION OF THE INVENTION

It is an object of the present invention to provide a convenient and easy to use storage hub for an outlet cap. Another object is the provision of a very inexpensive and effective means for minimizing the possibility of losing such a cap once it is removed from the outlet of the spigot.

These and other objects and advantages which will be readily appreciated are achieved in the manner to be hereinafter described in detail.

The present invention relates to a hub used to store a spigot cap. The hub comprises a generally U-shaped body having a base and a generally cylindrical wall provided with external threads. The hub includes means for securing the hub to a surface in proximity to a spigot. The body of the hub typically is made of a moldable or machineable polymeric or elastomeric material with the threads molded into the outer surface of the cylindrical wall. The body can also be made from a suitable metal with the threads cast or machined into the external surface to receive the outlet cap.

In one embodiment the base includes an axially extending hole for securing the hub to a mounting surface using a suitable fastener. The hole may be internally threaded for engaging a threaded stub at the end of the valve stem. In another embodiment, the hole is not threaded, but instead receives a bolt through the body of the hub for threadedly engaging a valve stem whereby the hub is secured to the handle of a spigot. If the hub is to be mounted onto a surface such as a wall next to the spigot, a screw, nail or rivet can be used to secure it in place. Another option is for an axially extending threaded fastener to be molded or embedded in the external surface of the hub base. The hub may then be screwed into a structural surface in proximity to the spigot. Alternatively, the stub can be threaded into a tapped hole in the top of the valve stem. Other alternatives are to magnetically secure the hub onto the top of the metal valve stem and handle, or to use an adhesive such as an epoxy or a methacrylate to anchor the hub to the valve handle or to the surface of an adjoining structure such as the side of a house or other building.

The invention also relates to a spigot for discharge of a fluid, the spigot including a handle, a valve stem and an outlet equipped with a cap. The spigot also includes a hub that serves to store a spigot cap. The hub comprises a generally U-shaped body having a base, a generally cylindrical wall with external threads to receive the spigot cap, and a fastener for securing the hub to a surface of the spigot. The hub may be secured to the spigot handle or the valve stem using an attaching means such as an adhesive, a threaded valve stem, or a magnet attracted to a ferromagnetic material embedded in the plastic body of the hub, or to the hub itself if the hub is made from a magnetically attractable metal. The body of the hub can be made of a moldable or machineable polymeric or elastomeric material with the cap-receiving threads disposed along the external surface of the cylindrical wall. The fastener can be a threaded fastener embedded in the base of the polymeric hub. A further alternative is for the hub and the valve handle to be molded, cast or machined from a singular piece of polymer, elastomer or metal to form a unitary part.

The invention further relates to a method of safeguarding a spigot cap provided with female threads, when the cap is removed from the threaded end of a spigot. The method comprises: a) providing a storage hub for the cap, said hub having male threads corresponding to the female threads on the cap; b) mounting the storage hub within easy reach of the spigot; and c) threading the cap onto the hub when the cap is not in use. The storage hub can be mounted onto the stem of the valve or the valve handle. Alternatively, the storage hub may be mounted onto a wall of a structure in proximity to the spigot.

DETAILED DESCRIPTION OF THE INVENTION

Figure 1:
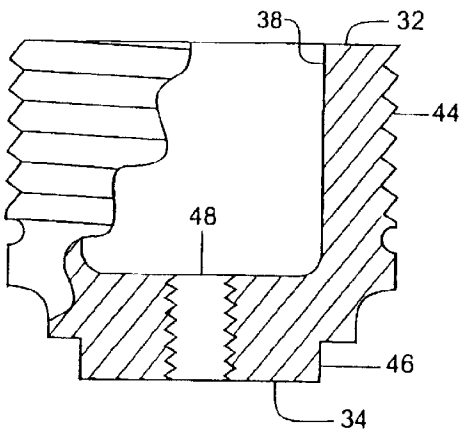
FIG. 1 is an elevational view of the storage hub of the present invention; partially cross-sectioned.

The present invention can be more easily understood by referring to the drawings that are included herewith. FIG. 1 is a view of the storage hub 32 in cross section. The hub comprises a generally cylindrical wall 38 and a base 34. The wall 38 is provided with external threads 44 adapted to receive the outlet cap (not shown). The base 34 optionally includes a cylindrical cut-away portion 46 that allows the base to fit within the rim of a valve handle. The external cylindrical surface between the cut away 46 and the threads 44 can be knurled or ribbed to permit the hub to be firmly grasped with the fingers. As shown, the hub is hollow, and is provided with a threaded hole 48 extending through the base 34 for purposes of securing the hub to the handle or the valve stem.

Figure 2A:
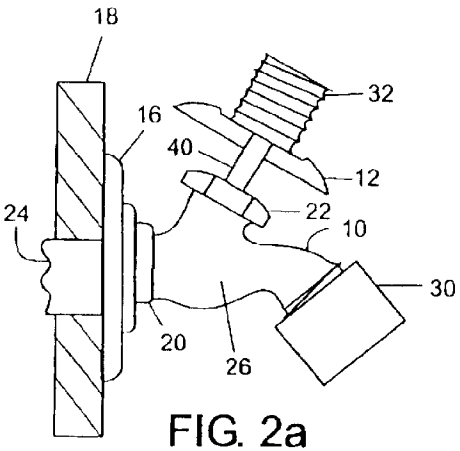
FIG. 2*a* is an elevational view, partially in cross section, of a wall mounted spigot showing an outlet cap in use.
Figure 2B:
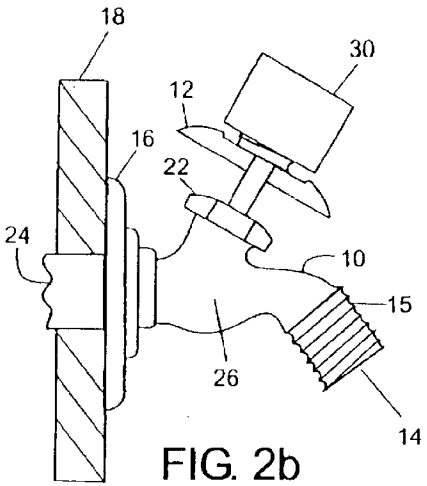
FIG. 2*b* is another elevational view, partially in cross-section, of the spigot with the outlet cap being stored.

Turning now to FIGS. 2*a* and 2*b*, there is shown a spigot 10 joined to a pipe 24 extending through a flange 16 and through the wall 18 of a structure such as a house (not shown). The pipe 24 in turn connects to a source of liquid, such as water, under pressure. The spigot includes a body 26, a valve stem 40 extending into the body, and a threaded nut 22 to hold the valve in place and to prevent leakage between the body and the valve stem. The spigot has a discharge outlet 14, typically provided with external threads 15 for attachment to a hose or other device to transport the liquid to a desired location. The spigot typically is cast from bronze or brass and has all of the standard features including a valve handle 12 that are well known in the plumbing field.

Shown threaded on to the outlet 14 in FIG. 2*a* is a cap 30 for preventing leakage from the spigot. A storage hub 32 is shown in FIG. 2*a* mounted on the valve stem 40 on top of the handle 12. FIG. 2*b* shows the cap 30 mounted on the hub 32 for storage when not in use.

Figure 3A:
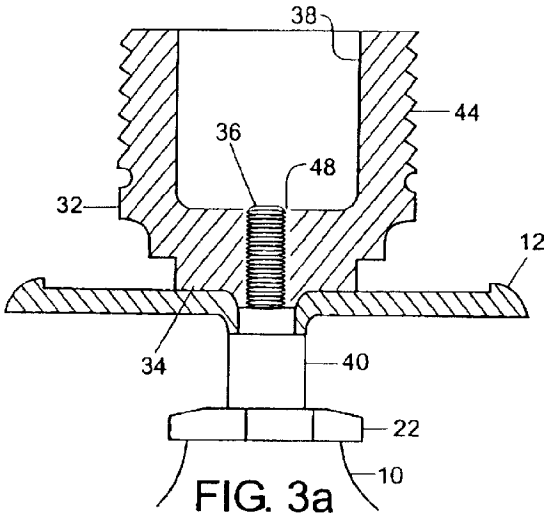
FIG. 3*a* is an enlarged view, partially in cross section showing a hub attached to the valve stem.
Figure 3B:
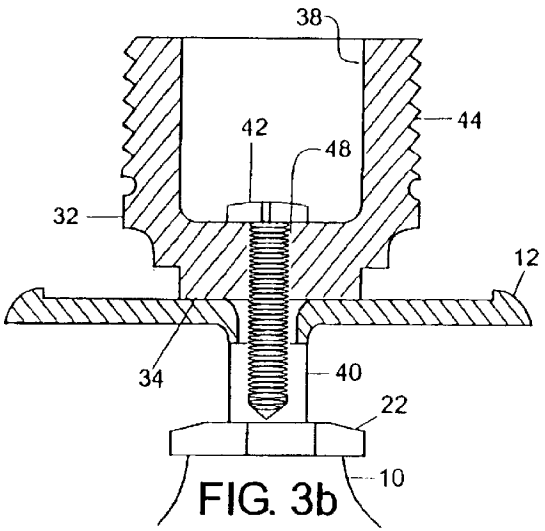
FIG. 3*b* is another enlarged view, showing an alternative means for securing the hub to the valve stem.

Two of the attachment options are shown in FIGS. 3*a* and 3*b*. In FIG. 3*a*, the valve stem 40 extends into the body 10 of the spigot and is secured thereto by the nut 22. The valve stem includes a threaded stub 36 that receives a handle 12. The base 34 of a hub 32 includes a threaded hole 48 that is threaded on to the stub 36 until the hub is secured against the central portion of the handle 12. In FIG. 3*b*, the valve body 10, the valve stem 40, the handle 12, and the lock nut 22 are as shown in FIG. 3*a*. However, the storage hub 32 is secured to the handle 12 by a bolt 42 threaded through the base 34 of the hub and into a tapped hole in the valve stem 40.

Figure 4:
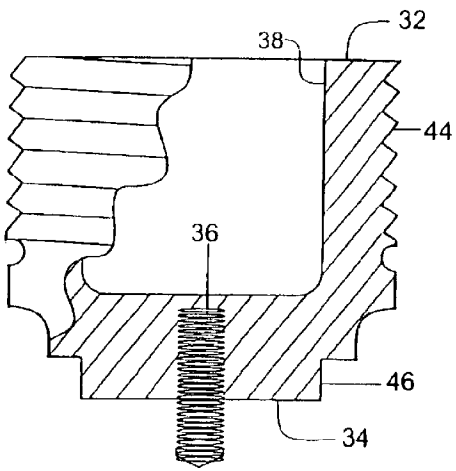
FIG. 4 is an elevational view of a hub with a molded-in threaded fastener.

FIG. 4 provides another option for attaching the hub 32 to the handle or to the stem of the valve. The hub comprises a generally cylindrical wall 38 and a base 34. The wall 38 is provided with external threads 44 adapted to receive the outlet cap (not shown). The base 34 optionally includes a cylindrical cut-away portion 46 that allows the base to fit within the rim of a valve handle. As shown, the hub is provided with a threaded stub 36 extending axially downward from the base 34 for purposes of threading the hub into the handle or the valve stem. The stub may be molded as a metal insert into the body of the hub. Alternatively, the stub can be molded or machined as an integral part of the hub.

Figure 5A:
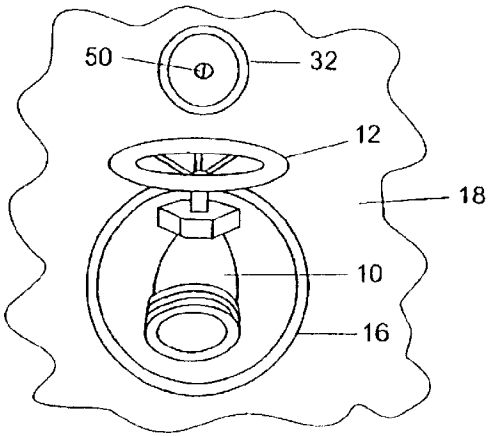
FIG. 5*a* is a front elevational view of a spigot, and a wall mounted storage hub.

Turning now to FIG. 5, an alternative embodiment is shown for the temporary storage of the cap. In FIG. 5*a* the spigot 10 extends through wall flange 16 into the wall 18 and is connected to a source (not shown) of liquid. A conventional handle 12 is used as before to turn the flow of liquid on and off. Mounted to the wall 18 of the house or other structure is a hub 32, as previously described. The wall mounting can be achieved by the use of a screw 50 or a suitable adhesive, a bolt, nail or other suitable fastener.

Figure 5B:
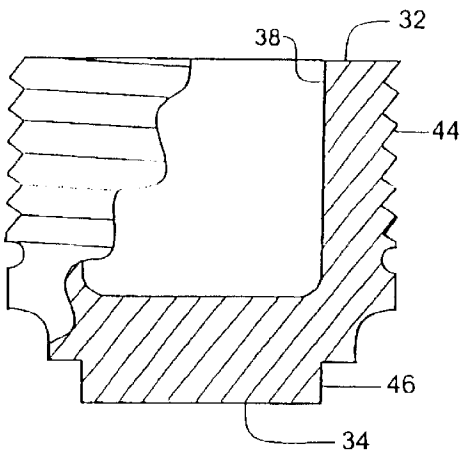
FIG. 5*b* is an elevational view, partially cross sectioned, showing a wall mounted hub shown in FIG. 5*a*.

FIG. 5*b* is a view of another storage hub 32 partially in cross section. The hub has a generally cylindrical wall 38 and a base 34. The wall 38 contains external threads 44 adapted to receive the outlet cap (not shown). As previously mentioned, the base 34 optionally includes a cylindrical cut-away portion 46 that allows the base to fit within the rim of a valve handle. To provide a larger surface area for the hub 32 to be adhesively or magnetically joined to the wall of a structure in proximity to a spigot, the base 34 of the hub does not contain any hole. If the hub is not fabricated from a material that is attracted to a magnet, it should be understood that a small disc of a magnetic material or a ferromagnetic material may be embedded in the base 34 of the hub 32, or adhered to the external surface of the base. A corresponding disc can likewise be attached to a wall near to the spigot. If the hub is to be adhesively attached to the structural surface, the base of the hub can be provided with an adhesive surface that is covered with a protective layer of film until ready to be mounted. Then the film is removed and the freshly exposed adhesive layer is pressed against the structure to securely attach the hub to the structure.

It should be understood that the objectives of the present invention can be achieved by other means as well as those articulated herein without departing from the scope and intent of the present invention. Thus, for example, the hub and the spigot handle can be fabricated as a single unit, either from metal or from a suitable polymer or elastomer using techniques well known in the fabrication art.

While the invention has been described in combination with embodiments thereof, it is evident that many alternatives, modifications and variations will be apparent to those skilled in the art in light of the foregoing teachings. Accordingly, the invention is intended to embrace all such alternatives, modifications and variations as fall within the spirit and scope of the appended claims.

What is claimed is:

1. A hub serving to store a spigot cap, said hub comprising a generally U-shaped body comprising a base, a generally cylindrical wall having external threads to engage the spigot cap, and fastening means for securing the hub to a surface in proximity to an outlet of a spigot.

2. The hub according to claim 1, wherein the body is made from a material selected from the group consisting of moldable or machineable polymeric or elastomeric material, and metal.

3. The hub according to claim 1, wherein the threads are disposed on the external surface of the cylindrical wall.

4. The hub according to claim 3, wherein the cylindrical body is hollow.

5. The hub according to claim 4, wherein the base includes an axially extending hole for securing the hub to said surface in proximity to the spigot outlet.

6. The hub according to claim 5, wherein the hole is threaded to engage a threaded stub projecting out of the stem of a spigot.

7. The hub according to claim 5, further including a bolt in the hole adapted to threadedly engage a valve stem whereby the hub may be secured to the handle of a spigot.

8. The hub according to claim 1, wherein the fastening means is selected from the group consisting of an adhesive fastener, a threaded stud onto which the hub is threaded, a magnetic fastener, a nail, a threaded bolt, and a screw.

9. The hub according to claim 8, wherein the fastening means is a threaded fastener embedded in the base of the hub.

10. A spigot for discharge of a fluid including a handle, a valve stem and an outlet, equipped with an outlet cap, said spigot further including a hub serving to store a spigot cap, said hub comprising a generally U-shaped body comprising a base having external threads to engage the spigot cap, a generally cylindrical wall, said hub secured to a surface of the spigot.

11. The spigot according to claim 10, wherein the hub is secured to the spigot handle.

12. The spigot according to claim 11, wherein the hub is secured to the handle using an attaching means selected from the group consisting of an adhesive, a threaded fastener, and a magnetic fastener.

13. The spigot according to claim 11, wherein the hub and the valve handle are unitary.

14. The spigot according to claim 10, wherein the body of the hub is made of a moldable or machineable polymeric or elastomeric material or metal.

15. The spigot according to claim 14, wherein the fastening means is a threaded fastener embedded in the base of the hub.

16. A method of safeguarding a spigot cap provided with female threads, when the cap is removed from the outlet of a spigot, comprising the steps of:

a) providing a storage hub for the cap, said hub having male threads corresponding to the female threads on the cap;

b) mounting the storage hub within easy reach of the spigot; and c) threading the cap onto the hub when the cap is not in use.

17. The method according to claim 16, wherein the storage hub is mounted onto the stem of the valve.

18. The method according to claim 16, wherein the storage hub is mounted onto a wall of a structure in proximity to the spigot.

* * * * *